US008870726B2

(12) United States Patent
Watterson et al.

(10) Patent No.: US 8,870,726 B2
(45) Date of Patent: Oct. 28, 2014

(54) SYSTEM AND METHOD FOR EXERCISING

(75) Inventors: Scott R. Watterson, Providence, UT (US); William T. Dalebout, North Logan, UT (US); Michael Olson, Logan, UT (US)

(73) Assignee: ICON IP, Inc., Logan, UT (US)

( * ) Notice: Subject to any disclaimer, the term of this patent is extended or adjusted under 35 U.S.C. 154(b) by 680 days.

(21) Appl. No.: 12/960,436

(22) Filed: Dec. 3, 2010

(65) Prior Publication Data

US 2012/0115695 A1 May 10, 2012

Related U.S. Application Data

(60) Provisional application No. 61/412,373, filed on Nov. 10, 2010.

(51) Int. Cl.

| | |
|---|---|
| ***A63B 71/00*** | (2006.01) |
| ***A63B 26/00*** | (2006.01) |
| ***A63B 21/00*** | (2006.01) |
| ***A63B 23/02*** | (2006.01) |
| ***A63B 22/14*** | (2006.01) |
| *A63B 22/20* | (2006.01) |
| *A63B 21/068* | (2006.01) |
| *A63B 23/00* | (2006.01) |
| *A63B 22/00* | (2006.01) |

(52) U.S. Cl.

CPC ..... *A63B 22/208* (2013.01); *A63B 2022/206* (2013.01); *A63B 2208/0219* (2013.01); *A63B 23/0216* (2013.01); *A63B 2208/0214* (2013.01); *A63B 22/205* (2013.01); *A63B 22/14* (2013.01); *A63B 21/068* (2013.01); *A63B 2023/003* (2013.01); *A63B 22/0023* (2013.01); *A63B 2022/0033* (2013.01)

USPC ..... 482/140; 482/132

(58) Field of Classification Search

CPC ..... A63B 21/00185; A63B 23/02; A63B 23/0222; A63B 23/0227; A63B 2023/003

USPC ..... 482/71, 95, 131, 132, 140, 146

See application file for complete search history.

(56) References Cited

U.S. PATENT DOCUMENTS

| | | | |
|---|---|---|---|
| 624,995 | A | 5/1899 | Tellefsen |
| 682,988 | A | 9/1901 | Hazelip |

(Continued)

FOREIGN PATENT DOCUMENTS

| | | | |
|---|---|---|---|
| CH | 99125 | | 5/1923 |
| CN | 202169044 | U * | 3/2012 |

(Continued)

OTHER PUBLICATIONS

U.S. Appl. No. 60/541,744, filed Jan. 5, 2004 to Nelson, Published Jul. 27, 2006.

(Continued)

*Primary Examiner* — Oren Ginsberg

(74) *Attorney, Agent, or Firm* — Workman Nydegger

(57) ABSTRACT

An abdominal exercise device includes a support structure, a track movable relative to the support structure, and a body support member movable relative to the support structure and track. A locking mechanism attaches to the track, and selectively secures the track at a fixed orientation relative to the support structure. In a first state, the locking mechanism restricts the track from rotating relative to the support structure. In a second state, the locking mechanism allows the track to rotate relative to the support structure. In using the exercise device, the user may obtain any of three motions. A first motion is provided by sliding the body support member along the track. A second motion is provided by rotating the track relative to the support structure. A third motion is a combined motion in which the body support slides along the track and the track rotates relative to the support structure.

20 Claims, 9 Drawing Sheets

(56) References Cited

U.S. PATENT DOCUMENTS

| | | | | |
|---|---|---|---|---|
| 1,982,872 | A | 11/1932 | Husted | |
| 2,129,262 | A | 9/1938 | Cole | |
| 2,183,345 | A | 1/1939 | Brandon | |
| 3,589,720 | A | 6/1971 | Agamian | |
| 3,658,327 | A | 4/1972 | Thiede | |
| 3,759,511 | A | 9/1973 | Zinkin et al. | |
| 3,892,404 | A | 7/1975 | Martucci | |
| 4,004,801 | A | 1/1977 | Campanaro | |
| 4,066,868 | A | 1/1978 | Witkin et al. | |
| 4,101,124 | A | 7/1978 | Mahnke | |
| 4,176,836 | A | 12/1979 | Coyle | |
| 4,241,915 | A | 12/1980 | Moble et al. | |
| 4,383,684 | A | 5/1983 | Schliep | |
| 4,640,268 | A * | 2/1987 | Roberts | 601/24 |
| 4,781,372 | A * | 11/1988 | McCormack | 482/70 |
| 4,911,438 | A | 3/1990 | Van Straaten | |
| 4,930,769 | A | 6/1990 | Nenoff | |
| 5,029,848 | A | 7/1991 | Sleamaker | |
| D326,247 | S | 5/1992 | Armstrong et al. | |
| 5,169,363 | A | 12/1992 | Campanaro | |
| 5,224,909 | A | 7/1993 | Hamilton | |
| 5,354,251 | A | 10/1994 | Sleamaker | |
| 5,376,053 | A | 12/1994 | Ponder | |
| 5,429,567 | A | 7/1995 | Gerschefske | |
| 5,433,685 | A | 7/1995 | Winslow | |
| 5,435,799 | A | 7/1995 | Lundin | |
| D362,700 | S | 9/1995 | Breibart | |
| 5,499,961 | A | 3/1996 | Mattox | |
| 5,518,483 | A | 5/1996 | Oswald | |
| 5,527,249 | A | 6/1996 | Harris | |
| 5,573,485 | A | 11/1996 | Geschwender | |
| 5,575,740 | A | 11/1996 | Piaget et al. | |
| 5,582,565 | A | 12/1996 | Soria | |
| 5,620,403 | A | 4/1997 | Lundin | |
| 5,674,167 | A | 10/1997 | Piaget | |
| 5,718,660 | A | 2/1998 | Chen | |
| 5,746,688 | A | 5/1998 | Prager | |
| D397,745 | S | 9/1998 | Wu | |
| 5,906,564 | A | 5/1999 | Jacobsen | |
| 5,921,901 | A | 7/1999 | Palacios | |
| 5,938,571 | A | 8/1999 | Stevens | |
| 5,941,803 | A | 8/1999 | Chamberlain | |
| 6,024,677 | A | 2/2000 | Siwertz | |
| D425,585 | S | 5/2000 | Wu | |
| 6,071,217 | A | 6/2000 | Barnett | |
| 6,110,081 | A | 8/2000 | Barnett | |
| 6,183,397 | B1 | 2/2001 | Stearns | |
| 6,186,929 | B1 | 2/2001 | Endelman | |
| 6,196,954 | B1 | 3/2001 | Chen | |
| 6,231,489 | B1 | 5/2001 | McBride | |
| 6,244,995 | B1 | 6/2001 | Prsala | |
| 6,440,045 | B1 * | 8/2002 | Gaston | 482/140 |
| 6,607,472 | B2 | 8/2003 | Toole | |
| 6,634,996 | B2 | 10/2003 | Jacobsen | |
| 6,645,129 | B2 | 11/2003 | Eschenbach | |
| 7,083,536 | B2 | 8/2006 | Lu | |
| 7,125,371 | B2 | 10/2006 | Henderson | |
| 7,128,701 | B1 | 10/2006 | Ketcham | |
| 7,179,212 | B2 | 2/2007 | Hsiung | |
| 7,232,404 | B2 | 6/2007 | Nelson | |
| 7,244,217 | B2 | 7/2007 | Rodgers | |
| 7,270,628 | B2 | 9/2007 | Campanaro | |
| D565,134 | S | 3/2008 | Brown et al. | |
| D567,915 | S | 4/2008 | Brown et al. | |
| 7,455,633 | B2 | 11/2008 | Brown et al. | |
| D584,367 | S | 1/2009 | Augustine et al. | |
| 7,485,079 | B2 | 2/2009 | Brown et al. | |
| 7,585,263 | B2 | 9/2009 | Brown et al. | |
| 7,611,445 | B2 | 11/2009 | Brown et al. | |
| D631,519 | S * | 1/2011 | Chen | D21/689 |
| 7,878,957 | B1 * | 2/2011 | Chen | 482/140 |
| 7,951,050 | B2 * | 5/2011 | Raumann et al. | 482/79 |
| 8,043,199 | B1 * | 10/2011 | Barker | 482/140 |
| D659,777 | S * | 5/2012 | Watterson et al. | D21/689 |
| D660,383 | S * | 5/2012 | Watterson et al. | D21/689 |
| D671,177 | S * | 11/2012 | Sip | D21/689 |
| D671,178 | S * | 11/2012 | Sip | D21/689 |
| 2003/0022770 | A1 | 1/2003 | Lee | |
| 2004/0077468 | A1 | 4/2004 | Myles et al. | |
| 2004/0248713 | A1 | 12/2004 | Campanaro | |
| 2005/0085348 | A1 | 4/2005 | Kiefer | |
| 2005/0248713 | A1 | 11/2005 | Hirosue | |
| 2006/0100070 | A1 | 5/2006 | Abdo | |
| 2006/0166798 | A1 | 7/2006 | Nelson | |
| 2006/0211549 | A1 * | 9/2006 | Nohejl | 482/97 |
| 2007/0021280 | A1 | 1/2007 | Tyree | |
| 2007/0149370 | A1 | 6/2007 | Brown et al. | |
| 2007/0184949 | A1 | 8/2007 | Weir | |
| 2008/0070765 | A1 | 3/2008 | Brown et al. | |
| 2008/0070766 | A1 | 3/2008 | Brown et al. | |
| 2008/0207415 | A1 | 8/2008 | Tsai | |
| 2012/0115694 | A1 * | 5/2012 | Chen | 482/142 |
| 2013/0123083 | A1 * | 5/2013 | Sip | 482/145 |

FOREIGN PATENT DOCUMENTS

| | | |
|---|---|---|
| DE | 29919418 | 3/2003 |
| GB | 1318240 | 5/1973 |

OTHER PUBLICATIONS

Design U.S. Appl. No. 29/380,429, filed Dec. 3, 2010 to Watterson et al.

Design U.S. Appl. No. 29/380,428, filed Dec. 3, 2010 to Watterson et al.

* cited by examiner

SYSTEM AND METHOD FOR EXERCISING

CROSS-REFERENCE TO RELATED APPLICATIONS

This application is a non-provisional of, and claims the benefit of and priority to, U.S. Patent Application Ser. No. 61/412,373, filed on Nov. 10, 2010, and entitled "SYSTEM AND METHOD FOR EXERCISING," which application is expressly incorporated herein by this reference in its entirety.

TECHNICAL FIELD

The present disclosure relates generally to systems and methods for exercising. More particularly, the present disclosure relates to systems and methods for exercising abdominal muscles.

BACKGROUND

As part of a healthy lifestyle, physicians and other health and fitness professionals are advising people to make exercise a part of their daily routine. A comprehensive fitness plan may include both cardiovascular and strength training or resistance-based regimens, and can target a number of different muscle groups. Increasingly, fitness professionals are advising people to develop a well-defined and strengthened "core," not only because the appearance of a tight stomach is considered desirable, but because a healthy core also promotes overall health and wellness.

Historically, stand-alone exercises have been used to strengthen the core muscles and develop a tight stomach. In the case of both sit-ups and crunches, care must be taken to perform the exercise properly, or the person risks injury. Fitness equipment has also been developed to target the abdominal muscles. For instance, fitness centers and gyms offer a variety of exercise devices that can target the core, and may reduce the risk of injury to users. Unfortunately, such machines are often large and difficult to operate. Thus, such machines are often ineffective or impractical for home use.

One proposed solution for making core training equipment accessible is described in U.S. Pat. No. 7,611,445 to "Brown," and which is commercially available under the AB COASTER name. Brown discloses an exercise machine that purports to "work the abdominal and oblique muscle groups and isolate the upper and lower abdominal muscles in a biometrically neutral position." In particular, an exercise device in Brown includes front and rear supports with a track extending therebetween. An upper body support is attached to the front support and a sled that includes a knee pad slides along the track. The track may be arcuate in shape.

In addition, other abdominal or other exercise devices include those in U.S. Pat. No. 7,232,404, U.S. Pat. No. 7,455,633, U.S. Pat. No. 7,485,079, U.S. Pat. No. 7,585,263, U.S. Pat. No. 7,611,445, U.S. Pat. No. 7,651,446, U.S. Pat. No. 7,662,076, U.S. Pat. No. 7,731,637, U.S. Pat. No. D598,965, and U.S. Patent Publication No. 2007/0259760, as well as exercise devices sold under the trade names "AB CIRCLE PRO" and "AB CIRCLE MINI."

SUMMARY OF THE INVENTION

In one aspect of the present disclosure, an exercise device is provided, and may be used for exercising abdominal or other muscle groups. The abdominal exercise device may include a support structure, a track that is movable relative to the support structure, and a body support that moves along a length of the track.

In accordance with an aspect that may be combined with any one or more other aspects herein, a track is rotatable relative to a support structure.

In accordance with an aspect that may be combined with any one or more other aspects herein, a track is elongate.

In accordance with an aspect that may be combined with any one or more other aspects herein, a track is arcuate.

In accordance with an aspect that may be combined with any one or more other aspects herein, a track is inclined relative to the support structure.

In accordance with an aspect that may be combined with any one or more other aspects herein, the body support is slideably disposed relative to the track.

In accordance with an aspect that may be combined with any one or more other aspects herein, an exercise device includes one or more locking mechanisms.

In accordance with an aspect that may be combined with any one or more other aspects herein, a locking mechanism selectively secures a track at a fixed position or orientation relative to a support structure.

In accordance with an aspect that may be combined with any one or more other aspects herein, a locking mechanism has an engaged state and a disengaged state.

In accordance with an aspect that may be combined with any one or more other aspects herein, a locking mechanism in an engaged state restricts rotational or other movement of a track relative to a support structure, and in a disengaged state allows the track to rotate or otherwise move relative to the support structure.

In accordance with an aspect that may be combined with any one or more other aspects herein, a locking mechanism includes a pin for securing the track relative to the support structure.

In accordance with an aspect that may be combined with any one or more other aspects herein, a track of an exercise device has at least two configurations.

In accordance with an aspect that may be combined with any one or more other aspects herein, a track in a first configuration is linked to a body support that, when moving, changes its position relative to a support structure and the track.

In accordance with an aspect that may be combined with any one or more other aspects herein, a track in a second configuration is linked to a body support that, when moving, changes its position relative to a support structure but is optionally at a constant position relative to the track.

In accordance with an aspect that may be combined with any one or more other aspects herein, a track in a second configuration is linked to a body support that, when moved during exercise by a user, can be either purely rotational relative to the support structure or a combination of rotational and translational movement relative to the support structure.

In accordance with an aspect that may be combined with any one or more other aspects herein, a body support member has three available motions, including a purely translational motion, a purely rotational motion, and a motion that combines the translational and rotational motions.

In accordance with an aspect that may be combined with any one or more other aspects herein, an exercise device includes a means for selectively moving a track relative to a support structure.

In accordance with an aspect that may be combined with any one or more other aspects herein, a means for selectively moving a track relative to a support structure includes any combination of one or more locking mechanisms, handles, or a body support.

In accordance with an aspect that may be combined with any one or more other aspects herein, a locking mechanism is disposed at an end of a track.

In accordance with an aspect that may be combined with any one or more other aspects herein, a locking mechanism is proximate a mount at which a track is connected to a support structure.

In accordance with an aspect that may be combined with any one or more other aspects herein, an axis of rotation of a track is about perpendicular to the track.

In accordance with an aspect that may be combined with any one or more other aspects herein, an axis of rotation of a track is about tangential to an arc defined by rotation of the track about the axis of rotation.

In accordance with an aspect that may be combined with any one or more other aspects herein, a method for exercising may include moving a body support member along a track.

In accordance with an aspect that may be combined with any one or more other aspects herein, sliding a body support member along a track may include sliding a body support member so as to translate the body support member relative to the track and a support structure supporting the track.

In accordance with an aspect that may be combined with any one or more other aspects herein, a method for exercising may include rotating a track relative to a support structure.

In accordance with an aspect that may be combined with any one or more other aspects herein, a method for exercising may include rotating a track relative to a support structure while also sliding a body support member along a length of the track.

In accordance with an aspect that may be combined with any one or more other aspects herein, a method for changing a configuration of an abdominal exercise machine may include selectively engaging or disengaging a locking mechanism.

In accordance with an aspect that may be combined with any one or more other aspects herein, engaging a locking mechanism may include, or result in, restricting rotational movement of a track relative to a support structure.

In accordance with an aspect that may be combined with any one or more other aspects herein, disengaging a locking mechanism may include, or result in, releasing a track from a locked position so as to enable the track to rotate relative to a support structure.

DETAILED DESCRIPTION

Figure 1:
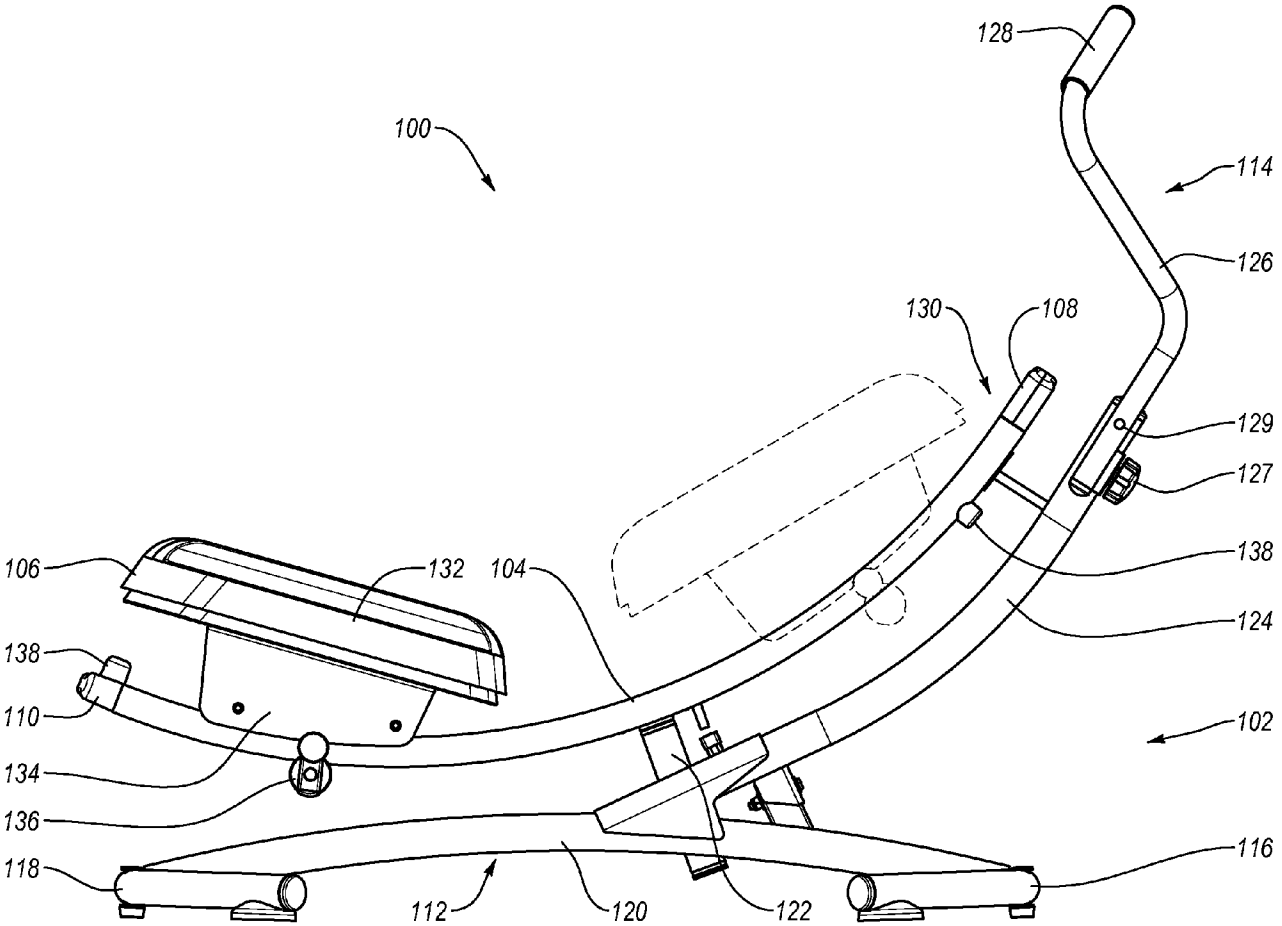
FIG. 1 is a side view of an exercise device according to one embodiment of the present disclosure.

In the embodiment shown in FIG. 1, an exercise device 100 includes a support structure 102 and a track 104 secured relative to the support structure 102. The exercise device 100 also includes a body support member 106 configured to support a body of a user and selectively move relative to the track 104. The support structure 102, track 104, and body support member 106 may have number of suitable configurations, shapes, components, or other features, or combinations of the foregoing. For instance, according to one aspect, the body support member 106 may be a sled adapted to operate as a knee pad or leg support.

The support structure 102 may have any number of suitable configurations. In the illustrated embodiment, for instance the support structure 102 is configured to support the track 104 and maintain the track 104 in an elevated position relative to a surface on which the support structure 102 rests. For instance, the support structure 102 may be placed on a floor or ground surface and cause the track 104 to remain elevated relative to the floor.

The distance between the track 104 and the surface on which the support structure 102 rests varies across a length of the track 104. For instance, in FIG. 1, the track 104 may have first and second ends 108, 110. The first end 108 may be elevated a greater distance relative to the second end, or vice versa. In the illustrated embodiment, for instance, a line between the first and second ends 108, 110 may be angled relative to the surface on which the support structure 102 rests. The amount of incline may vary. By way of example, in one embodiment, the incline is between about ten degrees and about thirty degrees. In other embodiments, however, the incline may be less than about ten degrees or more than about thirty degrees. Indeed, in other embodiments, the first and second ends 108, 110 may be elevated approximately the same distance relative to the surface on which the support structure 102 rests, such that the incline of the track 104 may be between about zero and about ten degrees. In other embodiments, the incline of the track 104 may be increased to be, for instance, between about thirty and about sixty degrees. The incline may also be selectively adjustable by the user.

The track 104 is further illustrated has having a curved shape that is upwardly concave. The type and degree of the curve in the track 104 may be varied. For instance the track 104 may be arcuate and have a circular, parabolic, ellipsoid, or any other curved shape, although in other embodiments, the track 104 may be straight, or have an upward convex curved configuration. In some embodiments, the track 104 may have any combination of the foregoing. For instance, the track 104 may have various curved or linear profiles along its length. Thus, the curve of the track 104 may transition between curves of different shapes or dimensions, as well as between straight, convex, or concave portions, or any combination of the foregoing.

The curved or inclined orientation of the track 104 can provide the user with the ability to exercise abdominal muscles in a manner similar to crunches or sit-ups, but in manner that preserves proper form and reduces the risk of injury. Furthermore, in a traditional sit-up, the user can "bounce" off the ground, and also has his or her hands behind his or her head. The "bounce" effect can use momentum to complete the sit-up, and the hands can be used to pull the head forward. As a result, momentum and muscles other than the abdominal muscles may be used in completing the sit-up. With the exercise device 100, the curved and/or inclined track 104 can reduce or eliminate the "bounce" effect and require the user to use the abdominal muscles, thereby more effectively working the core muscle region.

The track 104 may be elevated from a surface by the support structure 102 according to any number of different aspects. In the embodiment illustrated in FIG. 1, for instance, the support structure 102 includes a base 112 and an upright support 114. The track 104 can be supported or elevated using the base 112 and/or the upright support 114. In particular, in accordance with at least one aspect, the base 112 is configured to stabilize the exercise device 100. In the illustrated embodiment, stability is provided as the base 112 includes opposing forward and rear foot portions 116, 118, along with a cross support 120 between the forward foot portion 116 and the rear foot portion 118. The forward and rear foot portions 116, 118 may extend laterally outward (see FIG. 2) so as to increase the lateral footprint of the exercise device 100. As a result, the forces placed on the exercise device 100, including those associated with the weight of the exercise device 100, the weight of the user using the exercise device 100, and the forces exerted by the user during use of the exercise device 100, can be spread over a larger area, thereby stabilizing the exercise device 100 and the user, and reducing the risk that the user 100 will inadvertently cause the exercise device 100 to tip over.

In FIG. 1, the cross support 120 is also curved, and upwardly convex. It should be appreciated that the curve of the cross support 120 is merely exemplary. In other embodiments, the cross support 120 may, for instance, be substantially straight. In at least one aspect, a curved cross support 120 may facilitate elevating the track 102 relative to a floor or other surface on which the base 112 of the support structure 102 is placed.

The track 104 is optionally supported directly or indirectly by the cross support 120. For instance, the convex, lower side of the track 102 may rest directly on the cross support 120. In other embodiments, however, the track 104 may be displaced or elevated relative to the cross support 120. In FIG. 1, for instance, a track support 122 is attached to the cross support 120 and extends therefrom. The track 104 may then be connected at or near a distal end of the track support 122. The track 104 may thus be supported by the track support 122 in a manner that causes the track 104 to remain at a position that is offset or displaced from the base 112, including the cross support 120. For instance, the track 104 may be supported such that the track 104 is generally aligned with the direction of the cross support 120, although this is not necessarily the case, or may change during use of the exercise device 100.

The track support 122 may have any suitable construction, shape, or configuration. For instance, while a single track support 122 is illustrated as extending from the base 112, this is merely exemplary. In other embodiments, multiple track supports 122 may extend from the base 112, or one or more track supports 122 may support the track 104 without being attached to the base 112. For instance, the track support 122 may directly engage a floor or other surface, be cantilevered from the upright support 114, or otherwise support the track 104. The position and orientation of the track support 122 may also be varied. By way of illustration, the track support 122 in FIG. 1 is illustrated at an incline relative to vertical, and generally perpendicular to the incline of the track 104. In other embodiments, the track support 122 may be at an acute or obtuse angle relative to the track 104, may have a substantially vertical orientation, or may be otherwise configured.

Furthermore, in FIG. 1, the track support 122 is shown as being optionally attached to the track 104 at a location that is approximately centered along the arcuate length of the track 104. In other embodiments, the track support 122 may be offset at any distance from a center of the track 104. For instance, the track support 122 may be positioned at or near the first and/or second end 108, 110 of the track 104, or anywhere in between.

Optionally, the track 104 is connected or otherwise supported to the support structure 102 at multiple locations. By way of example, in FIG. 1, the support structure 102 includes an upright support 114 extending at least partially in a vertical direction relative to the base 112. The upright support 114 may include, for instance, a elevation structure 124 and a set of handles 126. The elevation structure 124 can be connected to the base 112 (e.g., at the cross support 120 and/or the forward foot portion 116), and extend at least partially in a vertical direction. The elevation structure 124 may be substantially vertical, may be inclined, may be curved, or have another structure, or any combination of the foregoing. In FIG. 1, for instance, the elevation structure 124 is curved and inclined such that the first support 124 extends from the base 112 in both vertical and horizontal directions.

The handles 126 are optionally connected to the elevation structure 124 of the upright support 114, and can include grips 128 for a user to grasp while using the exercise device 100. The handles 126 form an upper body support that may be fixed relative to the track 104, although this need not be the case. By fixing the handles 126 relative to the track 104, a user is able to stabilize his or her upper body and focus on exercising the abdominal muscles.

The position of the handles 126 may be permanent or adjustable. For instance, in FIG. 1 the handles 126 are connected to an adjustment member 127 that can be used to selectively adjust the height of the handles 126. In FIG. 1, the adjustment member 127 is coupled to the elevation structure 124, and may include a knob or other member that can be rotated to selectively disengage the handles 126, although a pop pin, clamp, or other adjustment mechanism may also be used. Upon disengaging the adjustment member 127, the handles 126 can slide or otherwise move vertically upward or downward. The user may then re-engage the adjustment mechanism 127 to secure the handles 126 at a desired position. In one embodiment, the handles 126 slide within channel braces, although in other embodiments, telescoping, gearing or other mechanisms may be used within the scope of the present disclosure.

The handles 126 are optionally pivotally connected to the elevation member 124. For instance, the adjustment member 127 may additionally or alternatively be used to selectively pivot relative to the elevation member 124. When the adjustment member 127 is disengaged, the handles 126 may be permitted to pivot, whereas the engaging the adjustment member 127 may fix the handles 126 at a desired orientation relative to the elevation structure 124.

Allowing the handles 126 to pivot between different positions allows a user to perform multiple types of exercises or to isolate a particular muscle or muscle group. For instance, in FIG. 1, the handles 126 are oriented such that grips 128 are positioned above the first end 108 of the track 104. If the handles 126 are rotated such that the grips 128 are positioned nearer the center of the track 104, the user may be allowed to lean backward, thereby targeting a wholly different set of muscles. If the handles 126 are rotated forward such that the grips 128 are positioned will in advance of the first end 108 of the track 104, the user may lean forward, thereby targeting still another muscle group.

Any suitable mechanism may be used to allow the handles 126 to pivot relative to the elevation member 124. For instance, a pivot pin 129 may extend through the handles 126 and the elevation member 124. When the adjustment member 127 is disengaged, the handles 126 can rotate freely around the pivot pin 129. Hinges, linkages or other structures that allow the handles 126 to rotate relative to the elevation member 124 may also be used. Optionally, the handles 126 may pivot during use of the exercise device 100, thereby facilitating targeting of multiple muscle groups.

As illustrated in FIG. 1, the track 104 may be at least indirectly connected to the upright support 114. For instance, in at least one aspect, a locking mechanism 130 may selectively secure the track 104 relative to the upright support 114. In particular, in FIG. 1, the locking mechanism 130 connects the first end 108 of the track 104 to the elevation structure 124 of the upright support 114. As discussed in greater detail herein, the locking mechanism 130 may be changeable between at least first and second states. For instance, the locking mechanism 130 may have a first, engaged state in which the track 104 is selectively secured at a fixed position relative to the vertical support 114, and a second, disengaged state in which the track 104 is released and allowed to rotate or otherwise move relative to the vertical support 114.

While FIG. 1 illustrates the locking mechanism 114 securing the track 104 to the elevation structure 124 of the upright support 114, it should be appreciated that this is merely exemplary. In other embodiments, for instance, the locking mechanism 114 may selectively lock or otherwise connect the track 104 to the handles 126, the cross member 112, the forward or rear foot portions 116, 118, the track support 122, or to any other suitable member or component. Inasmuch as release of the locking mechanism 130 can allow movement of the track relative to the support structure, the locking mechanism 130 is one example of a means for selectively moving the track relative to the support structure 102.

As also illustrated in FIG. 1, the body support member 106 may be slideably disposed relative to the track 104. In accordance with at least one aspect, the body support member 106 is configured to receive a portion of a user's body, and allow the user's body to move relative to portions of the exercise device 100. The user may grasp the handles 126 of the support structure 102 so as to gain leverage to facilitate movement of the user's body and the body support member 106, or may use the device without grasping the handles 126. According to at least some embodiments, the user may kneel or sit on the body support member 106, may place a leg or arm on the body support member 106, or otherwise place a portion of the user's body on the body support member 106 in a manner that facilitates exercise.

According to one aspect, the user may kneel on the body support member 106, such that the user faces the upright support 114. The body support member 106 may include a seat portion 132 on which the user places his or her knees or other portion of the body. In FIG. 1, the seat portion 132 is attached to a carriage 134 that slides relative to the track 104. For instance, the carriage 134 may include a slider 136 that connects to the track 104 and facilitates movement along the track 104. The slider 136 may roll or slide relative to the track 104. For instance, the slider 136 may include wheels, ball bearings, roller bearings, a rack and pinion, or other elements that roll along an upper, lower, interior, or exterior surface of the track 104. Additionally, or alternatively, the slider 136 may include linkage, a channel bracket, a belt clamp, clutching mechanism, or other sliding structure.

The track 104 can be made of any of a number of different materials, including metals, plastics, composites, organic materials, or other materials or combinations of the foregoing. According to some aspects, the track may have a coating, lubricant, or some other material that facilitates sliding of the carriage 134 relative to the track 104. For instance, a coating having a relatively low coefficient of friction can be used to reduce the friction between the slider 136 and the track 104, to provide a more fluid sliding motion to the body support member 106.

The shape and/or orientation of the track 104 may also provide various benefits to the user. For instance, where the track 104 is inclined, the body support member 106 may change elevation along the length of the track 104. As the body support member 106 increases in elevation, the body of the user can counteract gravitational forces, thereby contracting the abdominal muscles. The degree to which the abdominal muscles are contract, or the isolation of which muscles are contracted, can also be varied based on the position of the handles 126, such that various intensity levels or exercises are possible based on whether the user is upright, leaning forward, or leaning backward.

The body support member 106 can be configured to slide along all or a portion of the length of the track 104. In one aspect, the track 104 may include or have attached thereto one or more stops 138. The stops 138 can be used to engage the carriage 134 or slider 136 and restrict movement of the body support member 106. In FIG. 1, for instance, stops 138 are positioned near the first and second ends 108. 110 of the track 104. More particularly, the body support member 106 may slide relative to the track 104 and towards the second end 110 of the track 104. As the carriage 134 engages the stop 138, the body support member 106 may be restricted from further movement towards the second end 110 of the track 104, thereby reducing the chance that the body support member 106 disengages the track 104 during exercise. Similarly, as the body support member 106 slides relative to the track 104 and towards the first end 108 of the track 104, the slider 136 may engage the stops 138. The stops 138 may be removable or excluded to allow the body support member 106 to have substantially a full range of motion along the track 104. It is also not necessary that stops 138 be included at the first and second ends 108, 110 of the track 104. For instance, in some embodiments, no stop may be included as the handles 126 and/or the elevation structure 124 of the upright support 114 may restrict movement of the body support member 106.

Figure 2:
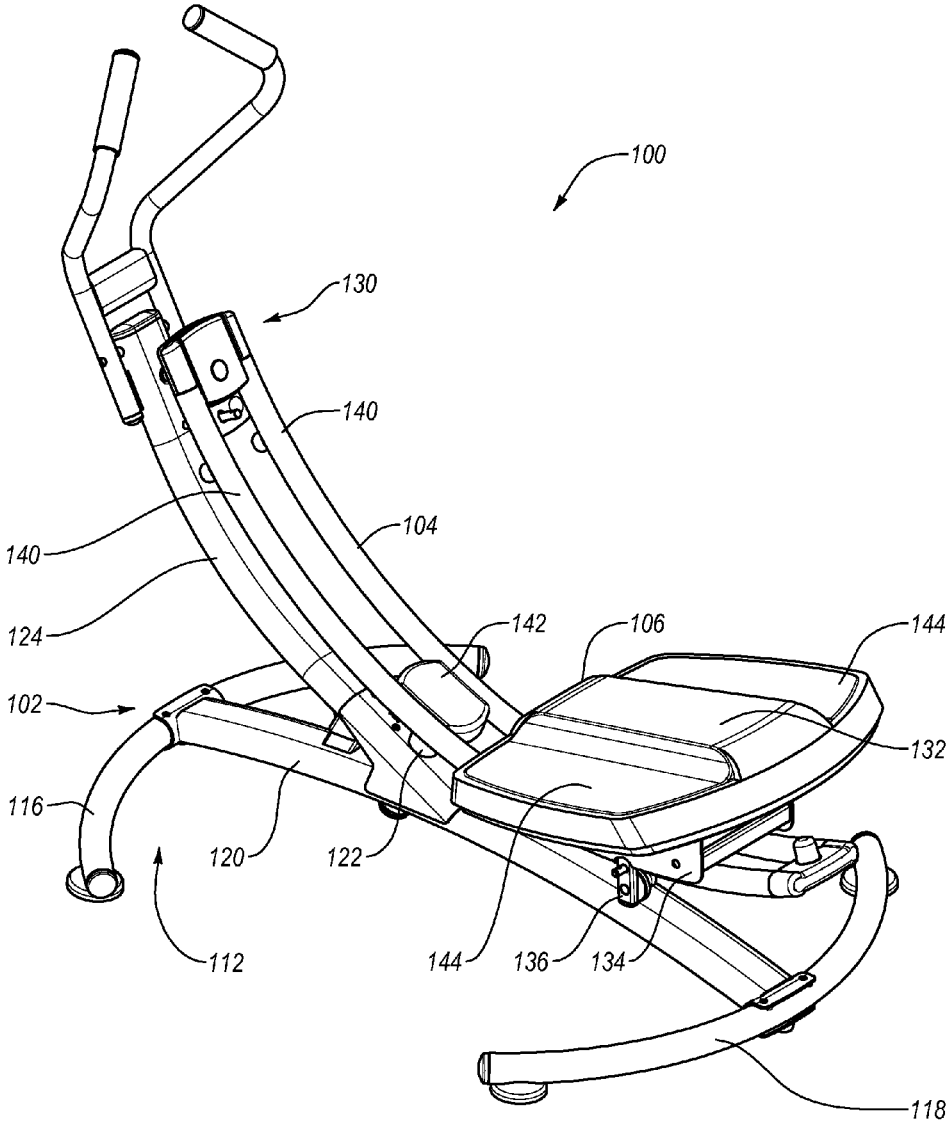
FIG. 2 is a perspective view of the exercise device of FIG. 1.

Turning now to FIG. 2, the exercise device 100 of FIG. 1 is illustrated in a perspective view, and illustrates other exemplary aspects of an exercise device according to the present disclosure. For instance, in the illustrated embodiment, the track 104 is illustrated as being elevated above the track support 122. As shown in FIG. 2, the track support 122 is connected to the cross support 120, and the cross support 120 is in turn connected to and/or supported by two foot portions 116, 118. The forward and rear foot portions 116, 118 are, in the illustrated embodiment, connected to the cross support 120 using mechanical fasteners such as bolts, screws, rivets, and the like, although in other embodiments other mechanisms may be used. For instance, the foot portions 116, 118 may be welded to the cross support 120, or may be integrally formed as a single unit using a casting, molding, machining, or other formation process. Further, while the foot portions 116, 118 are illustrated as separate, in some embodiments, a ring or other mechanism may fully surround the cross support 120.

The body support member 106 is also illustrated as including a seat portion 132 upon which a user may rest a portion of his or her body. In at least one aspect, the seat portion 132 is adapted to be knelt or stood upon and to allow a user to comfortably rest his or her knees, feet, or legs on the top surface of the seat portion 132. The seat portion 132 may be contoured to comfortably accommodate a user's leg. For instance, in FIG. 2, the seat portion 132 includes two indentions 144 configured to generally conform to the contours of a leg.

When a user has placed his or her body on the seat portion 132, the user may then move the seat portion 132 back and forth along the track 140. To facilitate such movement, the track 104 includes two guides 140 which are engaged by the slider 136. The two guides 140 of FIG. 2 have a curved, arcuate shape generally corresponding to and/or at least partially defining the curved, arcuate shape of the track 104. The guides 140 may also define the path along which the body support member 106 travels. The slider 136 may engage the guides 140 and slide relative thereto, thereby directing the slider 136 and the carriage 134 along the path defined by the guides 140 and the track 104. While the illustrated embodiment shows a set of two guides 140 that help to define a path of travel along at least a portion of the length of the track 104, this is exemplary and in other embodiments there may be a single guide or more than two guides.

In FIG. 2, a mount 142 is connected to the guides 140. The mount 142 may be used for any number of purposes. For instance, the mount 142 may be used to maintain the track 104 elevated relative to the base 112 of the support structure 102. Optionally, the mount 142 is positioned at least partially between the guides 140. For instance, the mount 142 may be formed separate from the guides 140 and directly or indirectly secured to the guides 140 in any suitable manner such as with mechanical fasteners, welding, brazing, or other mechanisms, or combinations of the foregoing. In another aspect, the mount 142 may be integrally formed with the guides 140 and/or the track 104.

The mount 142 can be used to connect the track 104 to the track support 122. The manner of connection may also be such that the track 104 is permitted to selectively move relative to the track support 122 and/or the base 112 of the support structure 102. For instance, in at least one aspect, the mount 142 may be pivotally connected to the track support 122. Consequently, the base 112 may remain in a relatively fixed position while the track 104 can be selectively rotated or otherwise moved relative to the base 112.

As discussed herein, movement of the track 104 relative to the base 112 may be selective. For instance, in at least one embodiment, a user may cause the body support member 106 to travel along a length of the track 104. Using his or her core muscles, the user may cause the track 104 to maintain in a relatively stationary position relative to the base 112. In some embodiments, the user maintains the track 104 stationary relative to the base 112. In other embodiments, a locking mechanism 130 may be used to at least partially maintain the track 104 stationary relative to the base 112.

Figure 3A:
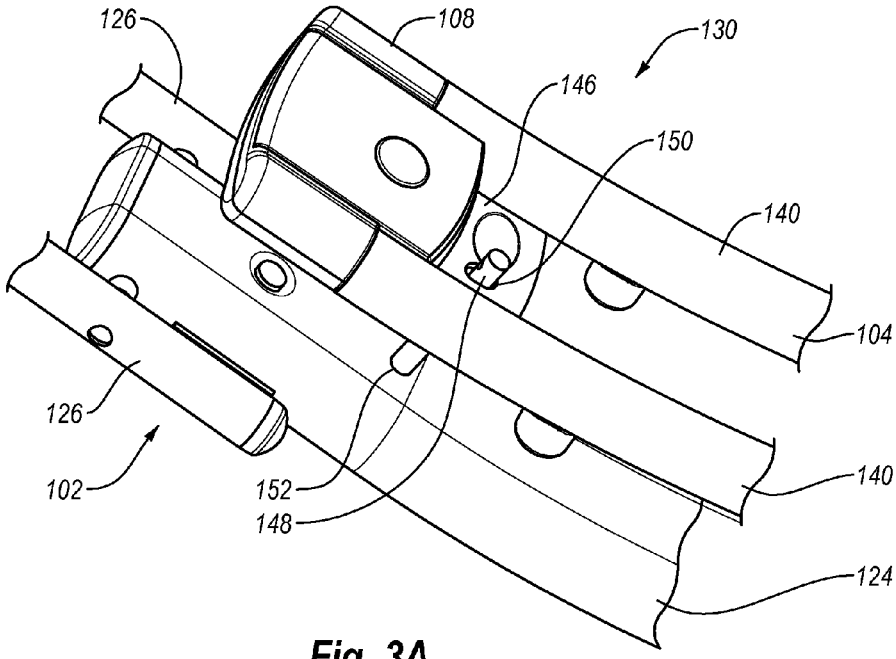
FIG. 3A is a partial perspective view of the exercise device of FIGS. 1 and 2, and illustrates a locking mechanism in an engaged state.
Figure 3B:
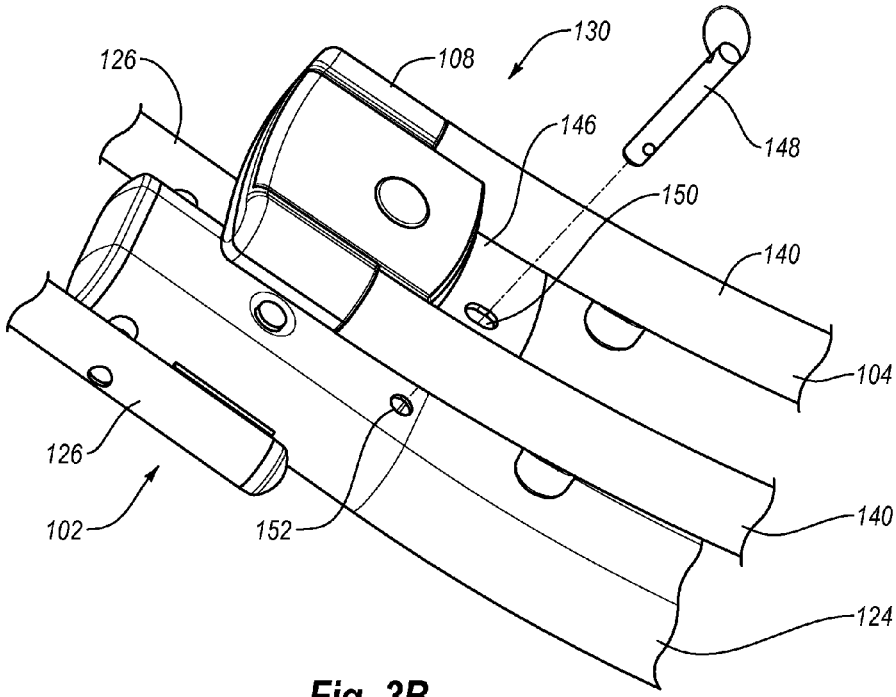
FIG. 3B is a partial perspective view of the exercise device of FIGS. 1 and 2, and illustrates a locking mechanism in a disengaged state.

FIGS. 3A and 3B illustrate the locking mechanism 130 of FIGS. 1 and 2 in greater detail. In particular, FIG. 3A illustrates the locking mechanism 130 in a first state, in which at least the first end 108 of the track 104 is substantially locked at a fixed position relative to the elevation structure 124 of the support structure 102. FIG. 3B illustrates the locking mechanism 130 in a second state, in which the first end 108 of the track 104 is released and may be selectively moved relative to the elevation structure 124 of the support structure 102.

More particularly, FIG. 3A illustrates a portion of the exercise device illustrated in FIGS. 1 and 2, and specifically illustrates the locking mechanism 130. In the illustrated embodiment, the locking mechanism 130 is proximate the first end 108 of the track 104, although this is merely exemplary. In other embodiments, for instance, the locking mechanism 130 may be positioned at a second end of the track 104, at a position between the ends of the track 104, or at any suitable location that allows the track 104 to be selectively placed in one or more states.

In FIG. 3A, the locking mechanism 130 includes a containment plate 146 that cooperates with a pin 148. The containment plate 146 is, in this embodiment, secured between the two guides 140 of the track 140, and defines a first aperture 150. The first support 124 of the support structure 102 includes a second aperture 152, and the first and second apertures 150, 152 are aligned in such a manner that the pin 148, when in a first position, can be positioned within both the first and second apertures 150, 152, and thereby simultaneously engage both the containment plate 146 and the first support 124. The first and second apertures 150, 152 thus define receptors such that in the first position, the pin 148 can thereby restrict movement of the first end 108 of the track 104 relative to the first support 124. For instance, the pin 148 can be used to restrict both rotational and translational motion of the track 104 relative to the first support 124.

The pin 148 may be movable between different positions. Accordingly, in at least some aspects, the pin 148 has a second position, which may also correspond to a second state of the locking mechanism 130. For instance, in a second state, the locking mechanism 130 may allow the track 104 to rotate, translate, or otherwise move relative to the support structure 102. FIG. 3B illustrates an example of such a second state of the locking mechanism 130. In the illustrated second state, the pin 148 has been retracted from the first and second apertures 150, 152. As such, the pin 148 has ceased simultaneously engaging both the track 104 and the first support 124, and thus been released from a motion-restrictive position.

In one embodiment, the pin 148 need not be retracted from both the first and second apertures 150, 152 to allow the locking mechanism 130 to transition from a first state to a second state. For instance, the pin 148 may be removed solely from the second aperture 152 to release the track 104 such that it is free to move relative to the support structure 102. Optionally, the pin 148 is biased. For instance, the pin 148 may included spring loaded bearings. The bearings may be compressible by forcing the pin 148 through one or both of the apertures 150, 152. The biased bearings may reduce the risk that the pin 148 becomes inadvertently displaced from the apertures 150, 152, but may be overcome by exerting a sufficient force on the pin 148.

As noted herein, when the locking mechanism 130 transitions between first and second states, the track 104 may also transition from a first, engaged state, to a second, disengaged state. In the engaged state, the track 104 optionally has a substantially fixed position relative to at least some portions of the support structure 102. In the disengaged state, the track 104 may be released to freely move relative to such same portions of the support structure 102.

Figure 4:
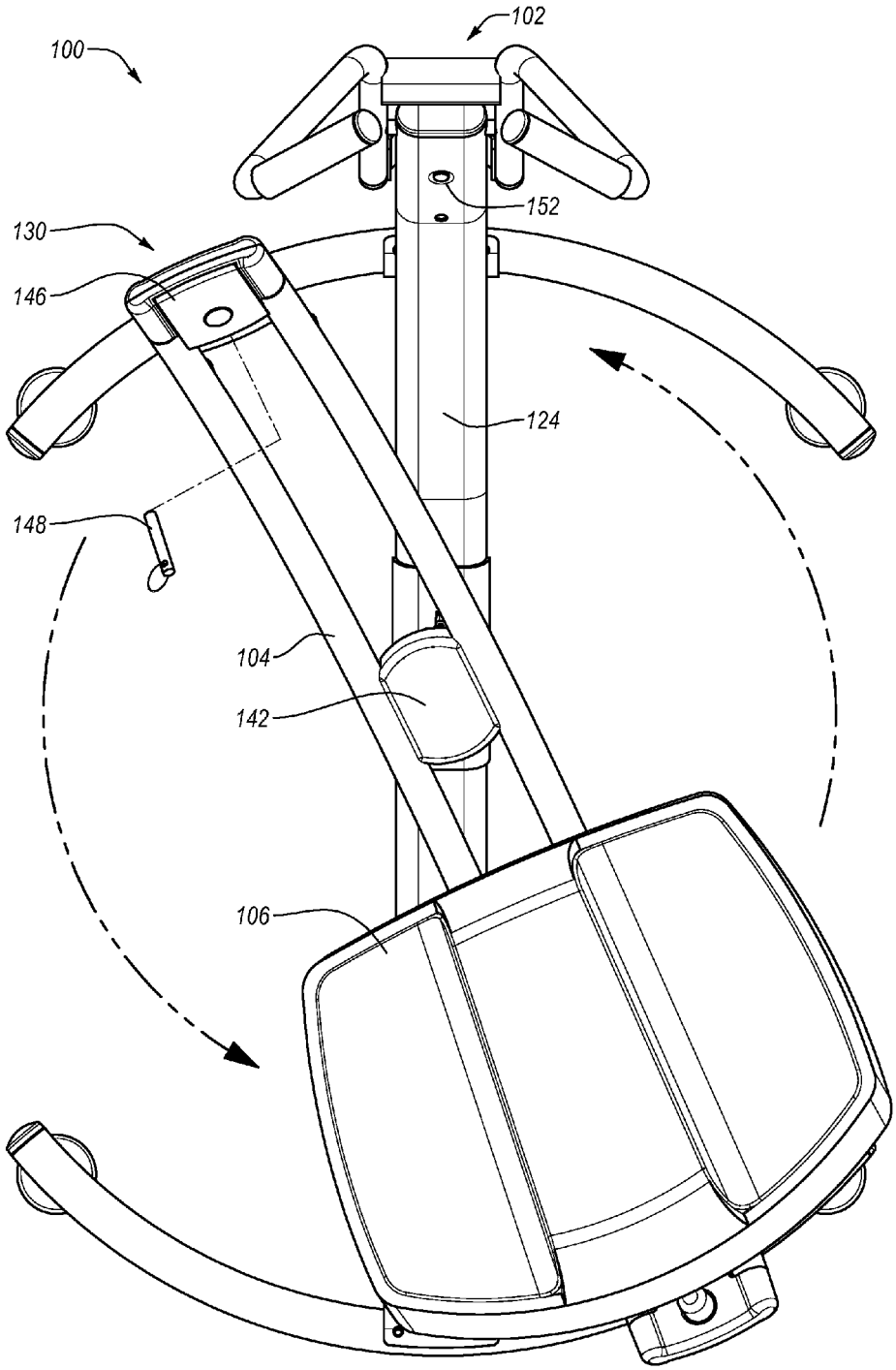
FIG. 4 is an overhead view of the exercise device of FIG. 1, the exercise device having a rotatable track.

FIG. 4 illustrates the exercise device 100 when the track 104 and locking mechanism 130 are in their respective disengaged states. In particular, in at least some aspects, the track 104 may be secured to the support structure 102 using a pivotal connection. More particularly, in the illustrated embodiment, the track 104 includes a mount 142 attached thereto. The mount 142 may also be attached to a track support 122 (see FIGS. 1 and 2). The mount 142 may connect to the track support 122 about a rotational axis that is optionally about perpendicular to the track 104. A user of the exercise device 100 may twist his or her lower body from side-to-side while using the exercise device 100 to not only exercise his or her left or right oblique muscles, but to also move the track 104 from side to side, as shown in FIG. 4. The user may, for instance, exert a force on the body support member 106 and/or the handles 126 to cause the track 104 to rotate from side-to-side, and may do so in a manner that alternates between exercising left and right oblique muscles. The user may also sliding the body support member 106 along the track 104. Thus, the user can exercise oblique muscles while also performing a crunch-like exercise and exercising multiple different abdominal muscles. As the user may use the handles 126 and/or the body support member 106 to provide leverage to selectively move the track, the handles 126 and the body support member 106 are each one example of a means for selectively moving the track 104 relative to the support structure 102.

While the locking mechanism 130 is in a disengaged state, a user can rotate the track 104 to a particular angular orientation relative to the support structure 102. Additionally, the user may then use his or her abdominal muscles to substantially maintain the track 104 at the particular angular orientation, while continuing to slide the body support member 106 along the track 104. For instance, FIGS. 5A and 5B illustrate a user performing an abdominal exercise on the exercise device 100, while the track 104 is in a disengaged state relative to the support 102.

Figure 5A:
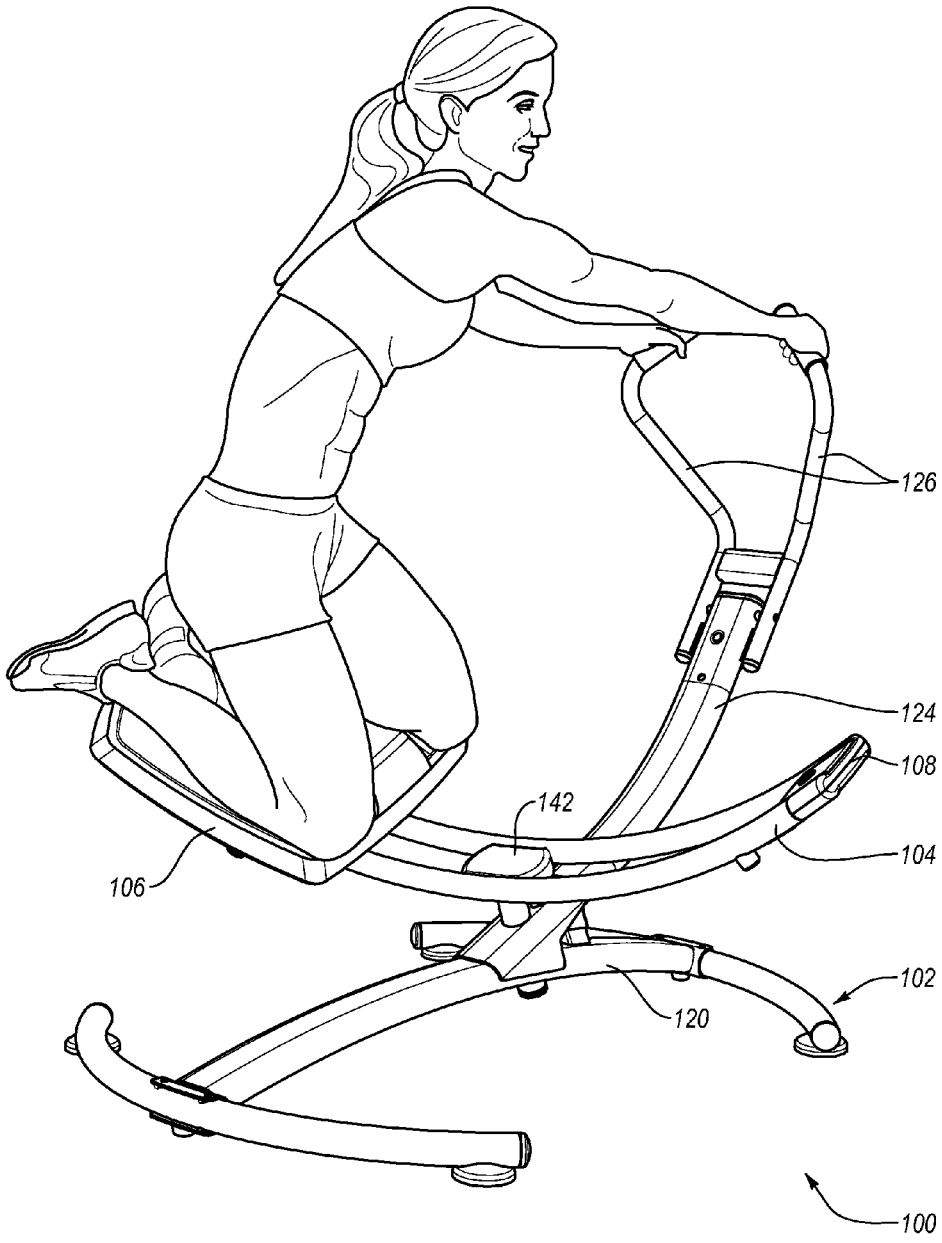
FIGS. 5A and 5B are perspective views of the exercise device of FIG. 1, in use by a user to rotate a track and translate a body support member along the track.
Figure 5B:
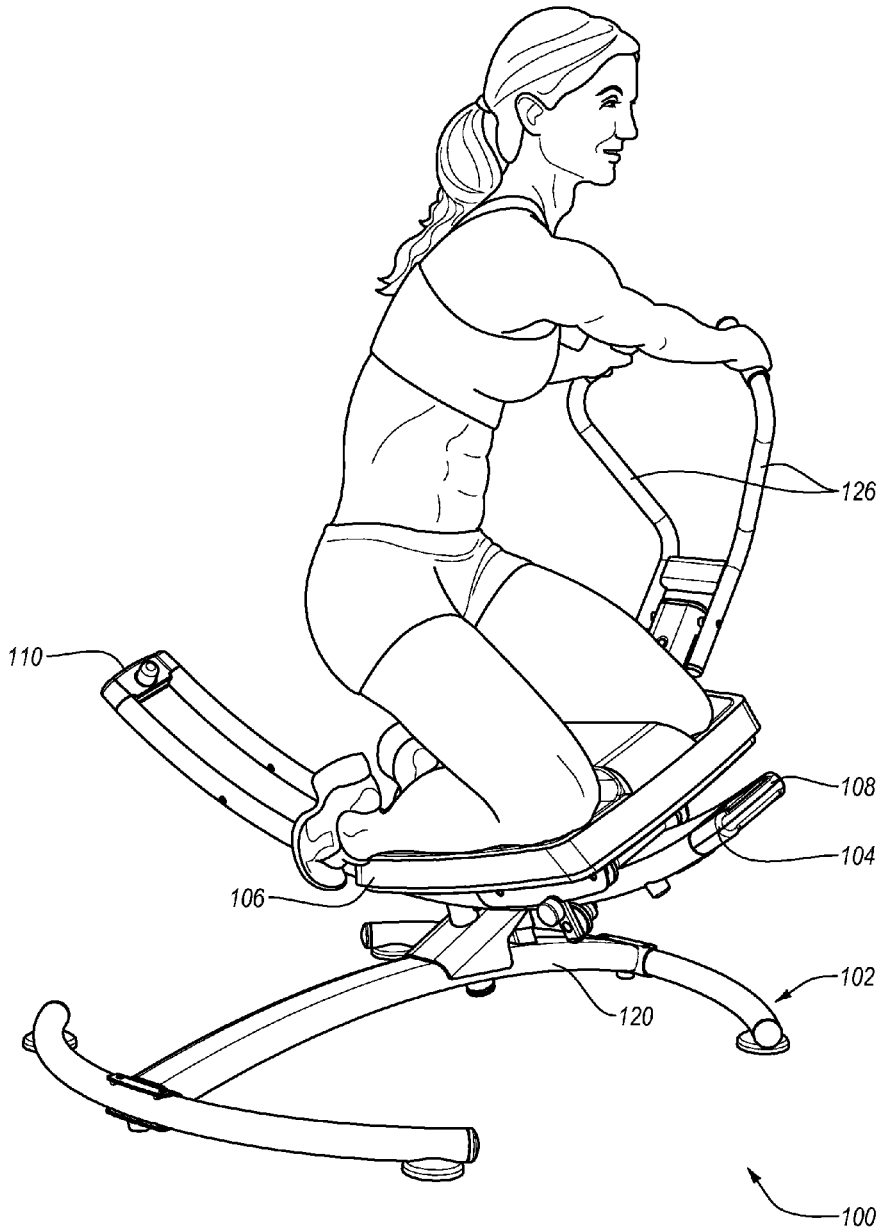

As shown in FIG. 5A, a user may use his or her hands to grasp the handles 126 of the exercise device 100. Using his or her oblique muscles, the user may rotate the track 104 to the position illustrated in FIG. 5A. For instance, the track 104 may rotate about an axis of rotation that is defined by the mount 142. In the illustrated embodiment, the track 104 is rotated to an angular position at which the track is about perpendicular to the cross-support 120 of the support structure 102, although the track 104 may be positioned at any number of other angular positions.

With the user's knees positioned on the body support member 106, the user may pull on the handles 126 and use his or her abdominal muscles to slide the body support member 104 along all or a portion of the length of the track 104. For instance, in FIGS. 5A and 5B illustrate the exercise device 100 having the track 104 at approximately the same orientation relative at the support structure 102; however, in FIG. 5B, the body support member 106 slides along the track 104 from a position near the second end 110 of the track (see FIG. 5A) to a position that is more proximate the first end 108 of the track 104.

Using the exercise device 100 described herein, the user can exercise each of the core muscle groups, and can also isolate particular core muscle groups. For instance, in accordance with one aspect, the user may isolate his or her oblique muscles by rotating the track 104 relative to the support structure 102 and maintaining the body support member 106 in a fixed position relative to the track 104, such that the body support member 106 also moves relative to the support structure 102. In another aspect, the user may isolate certain abdominal muscles by maintaining the track 104 at a fixed position relative to the support structure 102, and moving the body support member 106 relative to the track 104 and the support structure 102. Indeed, inasmuch as the track 104 may rotate relative to the support structure 102, and the body support member 106 may slide relative to the track 104, the exercise device 100 provides at least three exercise motions, namely: (a) a translational motion; (b) a rotational motion; and (c) a combined motion. In the combined motion, the user may simultaneously use both the translational and rotational motions provided by the exercise device 100.

Figure 6:
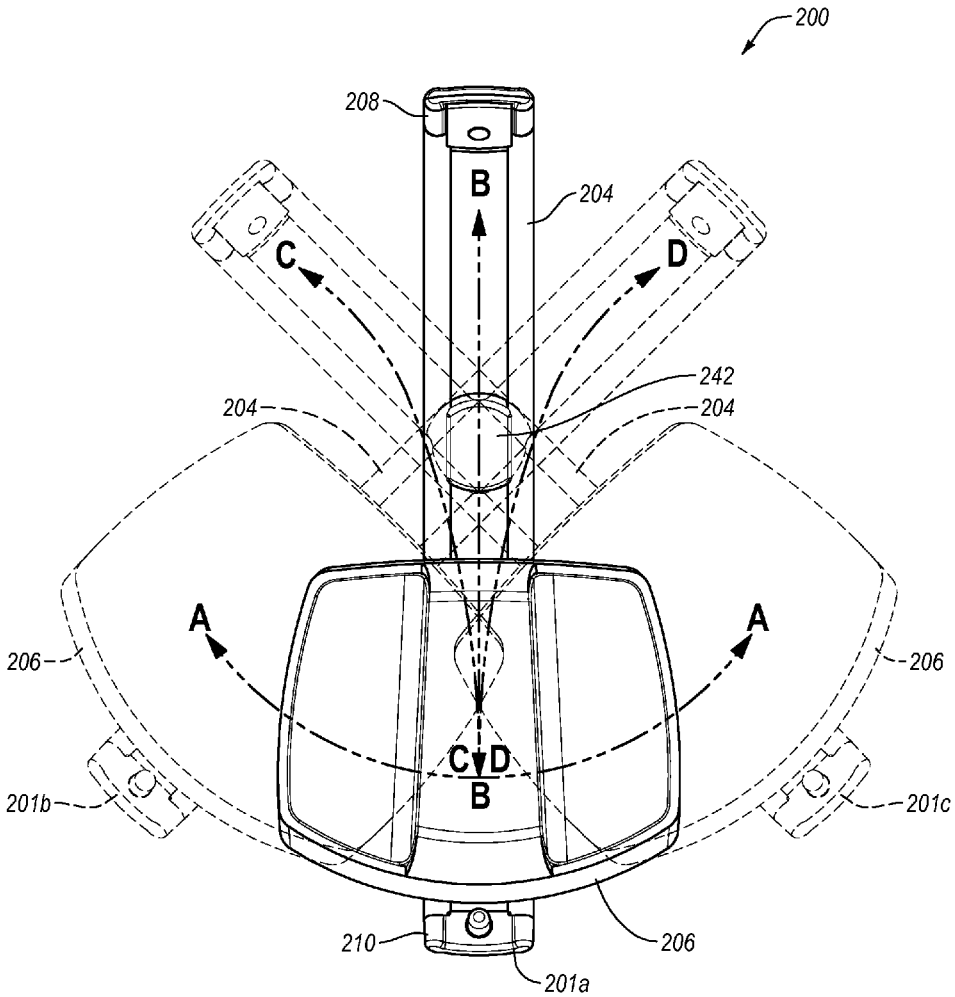
FIG. 6 illustrates an exercise device according to one embodiment of the present disclosure, the exercise device providing at least three motions.

FIG. 6 schematically illustrates an exercise device 200, along with some of the various exercise motions the user may perform using the exercise device 200. In the illustrated embodiment, the track 204 and the body support member 206 may be at a first position 201*a*. If the track 204 is allowed to freely rotate an axis of rotation defined by the mount 242, the track 204 and body support member 206 may freely move between positions 201*a*, 201*b*, and 201*c*. For instance, the track 204 and body support member 206 may be independently movable relative to each other and the support structure, such that a user may maintain the body support member 206 at a relatively fixed location along the length of the track 204, while the track 204 is rotated and moved from side-to-side between positions 201*b* and 201*c*. In so doing, the body support member 206 may follow a curved, arcuate path A-A. The arcuate path A-A may have a radius of curvature about equal to the distance between the body support member 206 and the mount 242. Thus, in at least one aspect, the track 204 and body support member 206 can rotate relative to a support structure (see FIGS. 5A and 5B), while the body support member 206 remains about stationary relative to the track 204. Optionally, the axis of rotation of the track 204 is oriented at an angle that is substantially tangential relative to the arc A-A defined by rotation of the track about the axis of rotation.

As also discussed previously, rather than maintaining the body support member 206 at a fixed position relative to the track 204, the body support member 206 may be allowed to slide or otherwise move along all or a portion of the length of the track 204. For instance, in FIG. 6, the track 204 may be at position 201*a*. While the track 204 remains substantially fixed at position 201*a*, the body support member 204 may move along the track 204 by following the path B-B. While the path B-B is illustrated as being substantially linear, one will appreciate in view of the disclosure herein, that the path may have other forms. For instance, the track 204 may be arcuate, such that the path B-B may be curved, arcuate, or take any number of other shapes and forms.

Path A-A and path B-B are merely illustrative of some example paths that a body support member 206 may take. For instance, such paths may illustrate movement of the body support member 206 relative to a structure supporting the track 204. In accordance with some aspects, paths A-A and B-B may also represent example paths facilitated by maintaining at least one element of the exercise device 200 at substantially constant position relative to another element. In particular, along path A-A, the body support member 206 may remain at a substantially constant position relative to the track 204. Along path B-B, the track 204 may remain at a substantially constant position relative to a support structure. Such constant positions may be maintained by the user or the exercise device. For instance, by using his or her core muscles, the user may maintain the track 204 at a constant position relative to the support structure, and/or maintain the body support member 206 at a constant position relative to the track 204. Additionally, or alternatively, the exercise device may include a locking mechanism or other structure that can fix the track 204 to a support structure, or can be used to lock the body support member 206 at a particular position along the length of the track 204.

In other aspects, the body support member 206 may follow still additional paths, thereby allowing a user to isolate different muscles, or exercise abdominal muscles at different intensities. More particularly, by moving the body support member 206 relative to the track 204, and by moving the track 204 relative to a support structure, the actual path of the body support member 206 may vary between an infinite number of possibilities. FIG. 6 illustrates two such options as path C-C and path D-D. In particular, paths C-C and D-D are about mirror images of each other, and illustrate example paths that the body support member 206 may follow if the body support member 206 translates along the track 204 and the track 204 is rotated about twenty-five degrees about an axis of rotation defined at least partially by the mount 242. The paths C-C and D-D are therefore obtained by combining the rotational movement of the track 204 (e.g., path A-A) with the translational movement of the body support member 206 (e.g., path B-B).

As the user uses the exercise device 200, a user can perform abdominal exercises similar to sit-ups or crunches by positioning his or her body on the body support member 206 and using the abdominal muscles. More particularly, the abdominal muscles can be used to accelerate the body support member 206 from the second end 210 of the track 204 towards the first end 208 of the track, while the user's knees are on the body support member 208. While paths A-A, B-B, C-C, and D-D are illustrated as extending in a single direction, a full repetition is completed by returning the body support member 206 to a resting position. While the return path may be the same as the initial path, the return path may also be varied.

While the positions 201*b* and 201*c* of the track 204 are illustrated in FIG. 6 as being angularly offset from position 201*a* by approximately twenty-five degrees, it should be appreciated that this is merely to provide one example of a manner in which a user may use the exercise devices described. The track 204 may, for instance, be rotated any suitable amount, and such rotation may be greater or less than twenty-five degrees. For instance, a user may rotate the track 204 about an axis of rotation by any amount between zero and ninety degrees, although in some embodiments, the track 204 may rotate a full three hundred sixty degrees. Furthermore the body support member 206 may also move any amount along the length of the track 204.

In embodiments in which the track 204 can rotate relative to a corresponding support structure (e.g., about an axis of rotation passing through the mount 242), the track 204 may be coupled to the support structure using a pivotal connection or other rotational coupling. In some embodiments, such a connection may allow the track 204 to rotate about an axis that is about perpendicular to the track 204. In FIG. 6, the axis of rotation may extend through the mount 242, which is, in this embodiment, positioned along the track 204 and between the opposing first and second ends 208, 210 of the track 204. For instance, the mount 242 and/or the axis of rotation may be about centered relative to the length of the track 204, although the location of the mount 242 or the axis of rotation may be varied.

Figure 7:
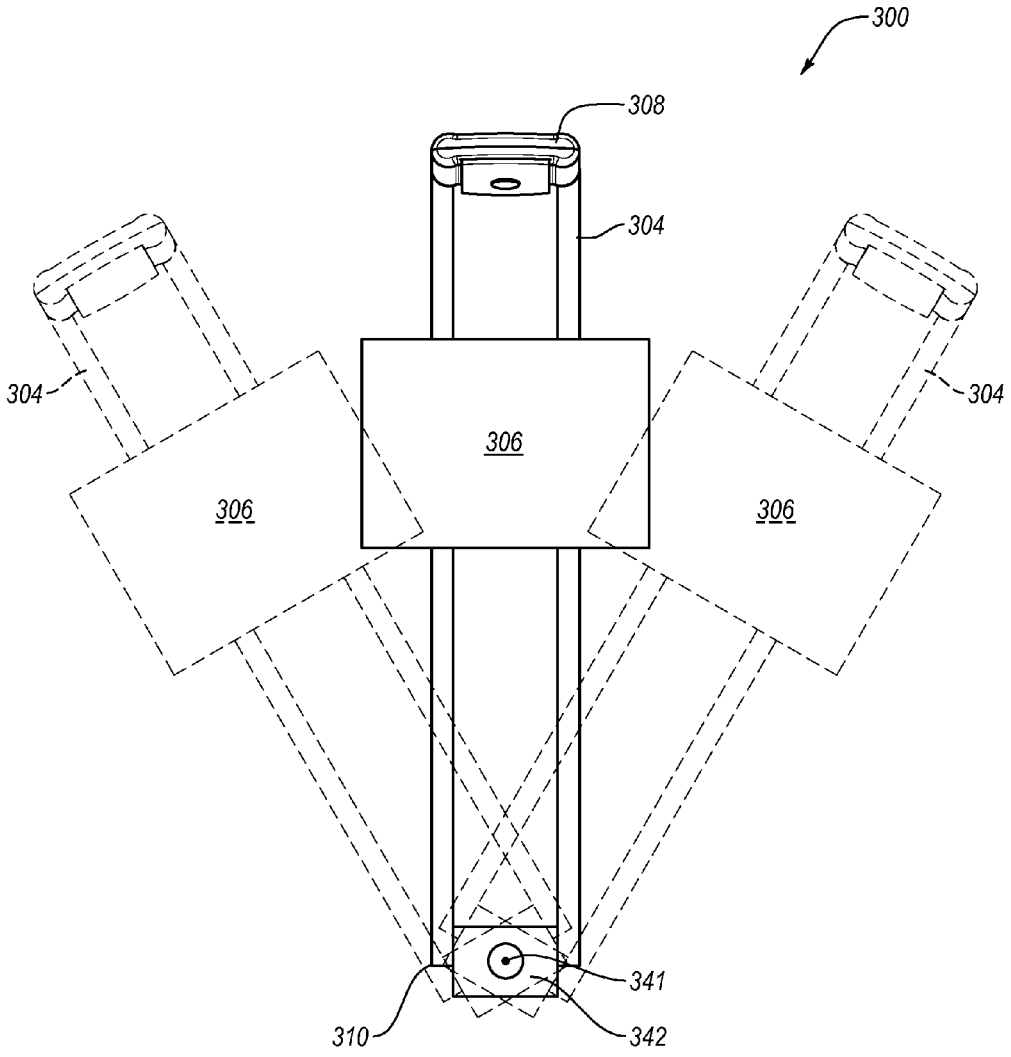
FIG. 7 illustrates an exercise device according to another embodiment of the present disclosure, the exercise device having a rotatable track.

For instance, FIG. 7 schematically illustrates an exercise device 300 having a track 304 that can rotate about an axis of rotation 341 that is at one end of the track 304. In this embodiment, the track 304 has opposing first and second ends 308, 310, and the axis of rotation 341 is proximate the second end 310 of the track 304. For instance, the first end 308 of the track 304 may be positioned near a support structure that allows a user to balance himself or herself (e.g., vertical support 114 of FIG. 1). A mount 342 or other structure may provide an axis or rotation 341 about the opposing second end 310 of the track 304. Consequently, the user may use his or her core muscles, arms, and/or legs to cause the track 304 to rotate about a point near the second end 310 of the track 304, thereby also rotating the body support member 306.

In some embodiments, the mount 342 may be movable relative to the track 304. For instance, a set screw or other mechanism may be used to selectively secure and release the mount 342 such that the mount 342 can move relative to the track 304. A user may, therefore vary the position of the mount 342 relative to the track 304. As a result, a user can change the position about which the track 304 rotates, and may also be able to change other parameters, such as the slope of the track 304.

Even in embodiments in which the mount 342 is movable along the length of the track 304, the track 304 may also be locked to selectively allow or restrict rotation. For instance, a locking mechanism may be positioned at the first end 308 of the track 304, and have various locking structures on a support structure to adjust for the various positions of the first end 308 relative to the support structure. In other embodiments, the locking mechanism may be placed at the second end 310 of the track. In still other embodiments, a locking mechanism may be positioned at the mount 342. For instance, if a locking mechanism is placed in an engaged state, the mount 342 may be restricted from rotating, thereby also restricting rotation of the track 304.

Figure 8:
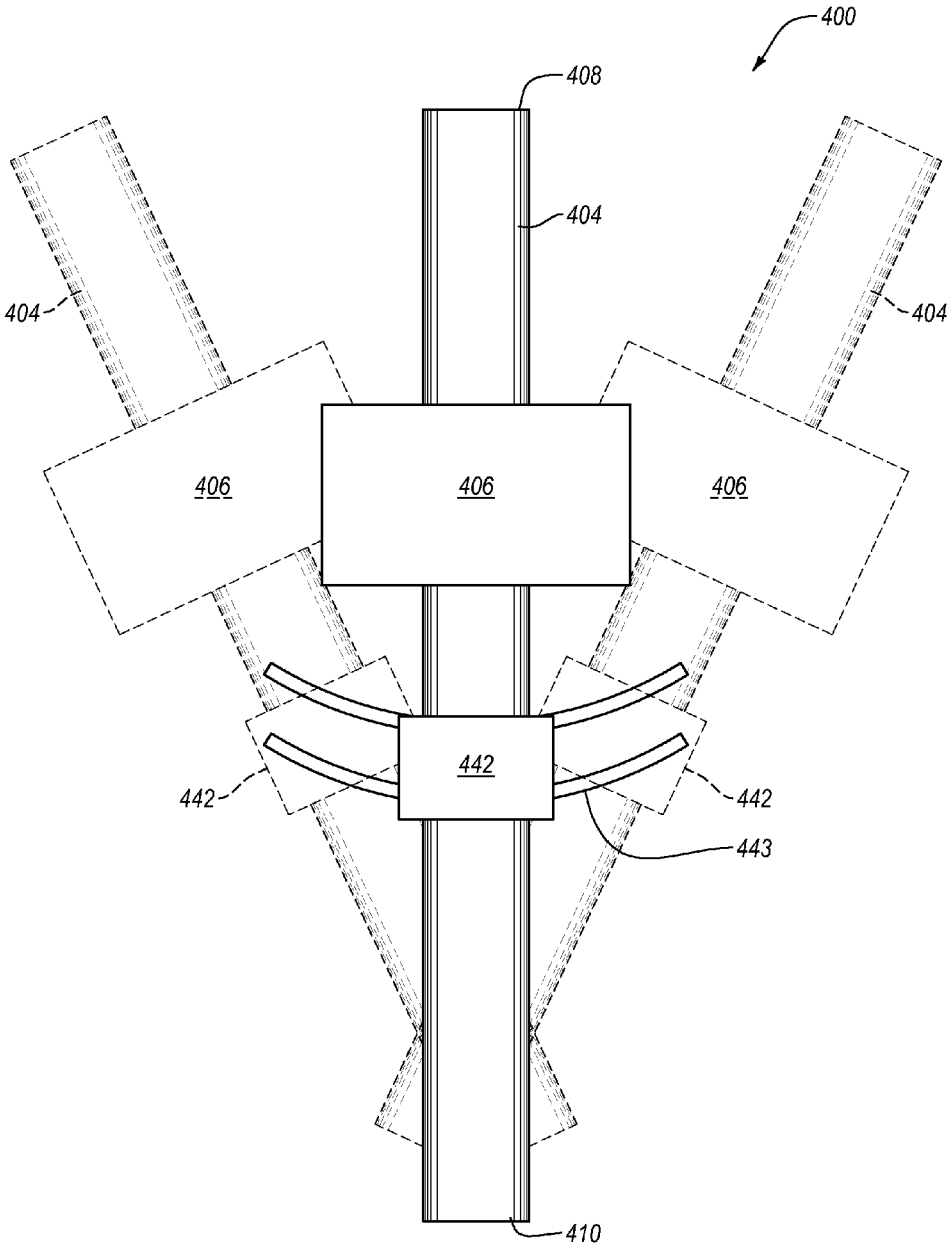
FIG. 8 illustrates an exercise device having a track and a slideable body support member, the body track being capable of translating and rotating.

FIG. 8 illustrates various features of an exercise device 400 in which a body support member 406 is connected to a track 404. The body support member 406 may be configured to slide along all or a portion of the length of the track 404. For instance, in FIG. 8, the track is configured as a rail and the body support member 406 may slide along the rail using rollers, bearings, linkages, and the like.

In some embodiments, the track 404 may also be configured to move in one or more manners. For instance, in FIG. 8, the support structure may define or include a guide 443 along which the track 404 may translate. In this embodiment, the guide 443 has a curved configuration; however, the guide 443 could be linear, S-shaped, or have any other suitable shape or form. For instance, in some embodiments, the track 304 may slide back and forth in a horizontal, lateral, or vertical direction, or in any combination thereof.

A mount 442 is coupled to the track 404 in FIG. 8. The mount 443 may also facilitate multiple movements with respect to the track 404. For instance, the mount 443 may facilitate rotational and/or translational movement of the track 404. In at least some embodiments, the mount 443 may slide along all or a portion of the length of the guide 443, thereby causing the track 404 to translate. For instance, the mount 442 may include, or have connected thereto, rollers, bearings, linkages, channel brackets, or other suitable mechanisms to facilitate translational movement of the track 404 along the guide 443.

Optionally, the track 404 may also rotate. For instance, in at least some embodiments, the mount 442 is connected to a support structure. Such a connection may be a pivotal or rotational connection. Consequently, a user may be able to cause the track 404 to rotate about an axis of rotation defined at least partially by the connection of the mount 442 to the support structure. For instance, FIG. 8 illustrates an example exercise device 400 in which the track 404 is translated along the guide 443 while also being rotated about an axis of rotation centered within the mount 442. More particularly, various available positions of the track 404 are illustrated in phantom lines, and include positions at which the track 404 is translated in opposing directions along the guide 443, and rotated at various different angular positions at mount 442.

As will be appreciated in view of the disclosure herein, the embodiment in FIG. 8 provides a user with a variety of different options for exercise. Such options may allow, for instance, the user to isolate various abdominal or other muscle groups in a customized and desired manner. By way of example, a user may combine the different available motions of the body support member 406 and track 404 in any of seven different manners. In particular, the user may: (i) translate the body support member 406; (ii) rotate the track 404; (iii) translate the track 404; (iv) translate the body support member 406 and rotate the track 404; (v) translate the body support member 406 and translate the track 404; (vi) rotate and translate the track 404; and (vii) translate the body support member while rotating and translating the track 404. In view of the disclosure herein, one skilled in the art will readily appreciate that a user's body may thus travel along an infinite number of exercise paths by using one or more available motions provided by the exercise device 400.

Furthermore, the exercise device 400 optionally includes one or more locking mechanisms such as those discussed herein. For instance, a locking mechanism may be used to restrict rotation of the track 404, translation of the track 404, translation of the body support member 406, rotation of the body support member 406, and the like. In some embodiments, multiple locking mechanisms may be used. For instance, a locking mechanism may be placed near the first end 408 of the track 404 and another locking mechanism may be placed near the second end 410 of the track 404. The user may independently engage or disengage the various locking mechanisms. By way of illustration, a locking mechanism at the first end 408 of the track 404 may be engaged to restrict translational movement of the track 404 along the guide 443. A locking mechanism at the second end 408 or at the mount 442 may be used to restrict rotational movement of the track 404 about an axis or rotation within the mount 442.

INDUSTRIAL APPLICABILITY

In general, available training methods for strengthening a person's abdominal muscles have traditionally included crunches or sit-ups, specialized equipment, or home equipment. Sit-ups and crunches have long been effective, but may increase a person's likelihood of injury as they are frequently performed improperly. Also, a person may inadvertently reduce the efficiency of such exercises by using muscles other than the abdominal muscles in performing the exercise.

Specialized equipment may also be available, but it is often difficult or non-intuitive to use, and is generally cost-prohibitive to a consumer. Such specialized equipment is therefore often found only in fitness centers and gyms. Use of such equipment may therefore be difficult, not only because of the difficulty of operating the equipment, but because of the time a user must dedicate to travel to and from the fitness center or gym.

More recently, home-use fitness products such as the AB CIRCLE PRO, AB CIRCLE MINI, and AB COASTER have been made available to consumers for home use. While such products purport to allow a user to efficiently strengthen and train abdominal muscles, recent research has shown that the muscle activity and caloric expenditure resulting from use of such devices is far from optimal. For instance, a recent study was performed in which research subjects exercised on a device that is the subject of the present disclosure, performed sit-ups and crunches, and also used each of the AB CIRCLE PRO, AB CIRCLE MINI, and AB COASTER. Using electromyogram (EMG) hardware and software to record electric currents associated with muscle contractions, peak and mean muscle activity was measured for each of the rectus abdominus, transverse abdominus, pectoralis major, biceps brachii, triceps brachii, trapezius, rectus femoris, biceps femoris, and gluteus maximus muscle groups. Participant heart rate and oxygen consumption were measured, and caloric expenditure was calculated for each condition.

Based on such research, muscle activation using the devices of the present disclosure far exceeded that for the AB CIRCLE PRO, AB CIRCLE MINI, and AB COASTER, and also exceeded that for sit-ups and crunches. For example, where the body support member had a combined side-to-side swiveling motion, as well as the translating glide motion along the track, exercise on the devices of the present application was found to activate 44% more total muscle than the AB CIRCLE MINI, and 37% more than the AB CIRCLE PRO. Use of the devices of the present disclosure was also found to activate a 34% greater muscle activation than the AB COASTER, even when the AB COASTER participants used a combined sliding and rotational motion. Metabolic measurements also demonstrated that users of the devices of the present application expended significantly more calories than on any of the AB CIRCLE PRO, AB CIRCLE MINI, and AB COASTER. For instance, participants using the devices of the present disclosure expended 33% more calories than users of the AB CIRCLE MINI and 35% more calories than users of the AB CIRCLE PRO.

The exercise devices of the present application thus permit users to perform simple, intuitive exercises while providing greater muscle activation and caloric expenditure than other available products. Moreover, because the exercise devices use gravity and/or a defined sliding path to exercise core muscle groups, the user can work out safely without placing excessive stress on joints or muscles. Accordingly, devices of the present application include easy-to-use, home or commercial exercise devices that may be desirable for use by any person, particularly those seeking to tone or strengthen their upper and lower abdominal muscles, burn fat, sculpt their body, or for any combination of the foregoing.

The exercise devices of the present disclosure are not only usable to enhance the abdominal strength of out-of-shape and overweight users, but are also effective for persons who hope to maintain their health or prevent the decline of their strength. The disclosed exercise devices may also be used to exercise, strengthen, and tone muscle groups other than the abdominal muscles, including muscles in a user's arms, legs, and upper and lower back.

While devices of the present application may provide resistance provided primarily by a user's body weight, the resistance may be increased by adding one or more resistance members. For example, resistance bands, springs, pneumatic members, shocks, and the like may extend along the track and/or between the track and support structure, to resist translational movement of the body support member, or rotational movement of the track. Weights may also be attached to increase the resistance. Optionally, the support structure may include an adjustable height mechanism that allows the front and/or rear feet portions to be elevated above the ground, thereby changing the incline of the track relative to the ground.

Further, while some devices in accordance with the present application may use a locking mechanism such as a pin to transition between different states or configurations, locking mechanisms may take any of numerous different forms. For instance, a pin may have a threaded configuration such that the pin engages mating threads within one or more corresponding threaded apertures. A retractable pin may also be replaced with still other configurations. For instance, a cog and sprocket, ratchet, clutch, tightening strap, clamp, knob, lug, pop pin, pin and yoke combination, spring release mechanism, brake, any other locking mechanism, or combinations of the foregoing may be used. Optionally, a retractable pin or other locking member may be accompanied by a tether, tie, or other retainer usable to connect the locking member directly or indirectly to a track or support structure, thereby reducing the risk that the locking member will be inadvertently removed and/or misplaced.

The devices disclosed herein thus allow a user to select which exercises to perform, what muscle groups to target, and the intensity and difficulty of the exercises being performed. Additionally, the devices provide safe and effective abdominal, back, leg, and arm exercises, making the exercise devices well-suited for home and commercial use.

What is claimed is:

1. An exercise device, comprising:

a support structure;

a track secured relative to the support structure, the track having an axis of rotation between a first end and a second end of the track along a longitudinal length of the track about which the track is configured to selectively rotate; and a body support member movable along and supported at least partially by the track.

2. The exercise device recited in claim 1, further comprising:

a locking mechanism, the locking mechanism being at least selectively secured to the track, wherein the locking mechanism has an engaged state and a disengaged state.

3. The exercise device recited in claim 2, wherein:

in the engaged state, the locking mechanism substantially restricts the track from rotating about the axis of rotation; and in the disengaged state, the track is selectively rotatable about the axis of rotation.

4. The exercise device recited in claim 2, the support structure and the track defining cooperating receptors, and the locking mechanism comprising a pin that engages the support structure and the track when selectively positioned within the cooperating receptors.

5. The exercise device recited in claim 2, wherein the locking mechanism is proximate the first end of the track.

6. The exercise device recited in claim 1, wherein the track is pivotally secured to the support structure.

7. The exercise device recited in claim 1, wherein the track defines an arcuate translation path for the body support member.

8. The exercise device recited in claim 1, wherein the axis of rotation is about centered along a length of the track.

9. The exercise device recited in claim 1, wherein the track defines a first path, and rotation of the track about the axis of rotation defines a second path, and wherein at least a third path is defined which combines the first and second paths.

10. The exercise device recited in claim 1, wherein the track defines a path such that the axis of rotation of the track extends in a direction that is substantially perpendicular to the path defined by the track, and substantially tangential to an arc defined by rotation of the track about the axis of rotation.

11. An exercise device, comprising:

a support structure;

a body supporting member that is selectively movable relative to the support structure; and a track linked to the support structure and the body supporting member, the track having an axis of rotation between a first end and a second end of the track along a longitudinal length of the track about which the track is configured to selectively rotate;

the track having at least first and second configurations in which:

in the first configuration, the body supporting member is selectively movable relative to the support structure and the track; and in the second configuration, the body supporting member is selectively movable relative to the support structure while remaining at a substantially constant position relative to said track.

12. The exercise device recited in claim 11, wherein in the first configuration, the body supporting member is selectively movable along a first path, and in the second configuration, the body supporting member is selectively movable along a second path.

13. The exercise device recited in claim 12, wherein the first path follows at least a portion of a length of the track and the second path is defined by a rotational motion of the track.

14. The exercise device recited in claim 12, wherein in the second configuration the body supporting member is selectively movable along at least a third path, the third path being a combination of at least a portion of the first path and the second path.

15. The exercise device recited in claim 11, wherein in the second configuration, the body supporting member is maintainable at a substantially constant translational position relative to a length of the track.

16. The exercise device recited in claim 11, further comprising a locking mechanism connected to the track, said locking mechanism having first and second states corresponding to the first and second configurations of said track.

17. The exercise device recited in claim 16, wherein when the locking mechanism is in the first state, the locking mechanism restricts the track from moving relative to the support structure.

18. The exercise device recited in claim 11, wherein the support structure includes a track support, wherein the track support elevates the track above at least a portion of the support structure, and wherein the track is pivotally connected to the track support.

19. The exercise device recited in claim 11, wherein in the first configuration, the track is substantially fixed relative to the support structure, and wherein in the second configuration, the track is movable relative to the support structure.

20. An exercise device, comprising:

a support structure;

a track secured to the support structure; and means for selectively moving the track relative to the support structure about an axis of rotation that is between a first end and a second end of the track along a longitudinal length of the track.

* * * * *